US009018571B2

(12) United States Patent
Eisenhart

(10) Patent No.: US 9,018,571 B2
(45) Date of Patent: Apr. 28, 2015

(54) WALL CONFIGURATIONS FOR GENERATING UNIFORM FIELD REFLECTION

(71) Applicant: Robert L. Eisenhart, Woodland Hills, CA (US)

(72) Inventor: Robert L. Eisenhart, Woodland Hills, CA (US)

( * ) Notice: Subject to any disclaimer, the term of this patent is extended or adjusted under 35 U.S.C. 154(b) by 0 days.

(21) Appl. No.: 14/204,184

(22) Filed: Mar. 11, 2014

(65) Prior Publication Data

US 2014/0263293 A1 Sep. 18, 2014

Related U.S. Application Data

(60) Provisional application No. 61/793,247, filed on Mar. 15, 2013.

(51) Int. Cl.

| | |
|---|---|
| ***H05B 6/80*** | (2006.01) |
| ***H05B 6/64*** | (2006.01) |
| ***H01P 1/17*** | (2006.01) |
| ***H05B 6/74*** | (2006.01) |

(52) U.S. Cl.
CPC ..... *H05B 6/6402* (2013.01); *H05B 6/74* (2013.01)

(58) Field of Classification Search
CPC ..... H05B 6/6402; H05B 6/74
USPC ..... 219/745, 746, 756, 748, 747, 750, 728, 219/754, 763, 687, 688, 696
See application file for complete search history.

(56) References Cited

U.S. PATENT DOCUMENTS

| | | | | |
|---|---|---|---|---|
| 2,943,175 | A * | 6/1960 | Guanella | 219/748 |
| 4,144,436 | A | 3/1979 | Hauck | |
| 4,196,332 | A | 4/1980 | MacKay et al. | |
| 4,301,347 | A | 11/1981 | Quine | |
| 4,316,069 | A | 2/1982 | Fitzmayer | |
| 4,324,968 | A | 4/1982 | Smith | |
| 4,336,434 | A | 6/1982 | Miller | |
| 4,354,083 | A | 10/1982 | Staats | |
| 4,861,956 | A * | 8/1989 | Courneya | 219/696 |
| 5,567,338 | A | 10/1996 | Idebro et al. | |
| 6,674,056 | B2 * | 1/2004 | Lee | 219/745 |

* cited by examiner

*Primary Examiner* — Quang Van
(74) *Attorney, Agent, or Firm* — Larry K. Roberts

(57) ABSTRACT

A microwave oven includes an oven cavity, defined by flat, electrically conductive oven walls. A microwave source generates microwave energy including orthogonal linearly polarized components into the oven cavity from a port formed in a first one of the oven walls. A grid wall of conductive lines parallel to a polarization direction is spaced from a second oven wall by a distance nominally equivalent to a quarter wavelength of the microwave energy.

17 Claims, 10 Drawing Sheets

Source side view showing Vertically polarized E-field, and glass platter

View from the source wall.
Waveguide source is both tilted 45 degrees and offset from the center of the wall. Note the arrow indicating the orientation of the E-field polarization.

WALL CONFIGURATIONS FOR GENERATING UNIFORM FIELD REFLECTION

CROSS-REFERENCE TO RELATED APPLICATION

This application claims priority from U.S. Provisional Patent Application No. 61/793,247 filed Mar. 15, 2013, the entire contents of which application is hereby incorporated by reference.

BACKGROUND

When an electromagnetic (EM) wave is incident upon an interface (or boundary) between two different types of materials the result is a reflected wave back into the primary material and a transmitted wave into the secondary material. This is true regardless of the materials as long as they are different. One special case is when it is important to contain the initial wave within the primary material by using a metal wall as the secondary material. The reflected wave is then nearly 100% of the incident energy and interacts with the incident wave to create "standing waves" or modes in the volume of the primary material. These modes are a varying energy profile of peaks and nulls, and this is true regardless of the polarization and incident angle of the incident wave.

A common example of this special case is in a microwave oven, used for cooking and heating of foods where the primary material is simply air and the secondary materials are the metal walls forming a cavity. For example, typical microwave ovens are designed with flat metal walls, the result of which are 3-dimensional modal patterns in the electric field, contributing to the uneven heating (cooking) of food. To smooth out the heating characteristics, a rotating turntable is commonly utilized to support the food so the cooking averages within the field due to moving the food. While this does provide better average heat distribution, there still is significant variation in the cooking.

BRIEF DESCRIPTION OF THE DRAWINGS

Features and advantages of the disclosure will readily be appreciated by persons skilled in the art from the following detailed description when read in conjunction with the drawing wherein:

FIG. 3B is a side view, looking from the side wall with the waveguide port to the opposite side wall.

DETAILED DESCRIPTION

Figure 1A:
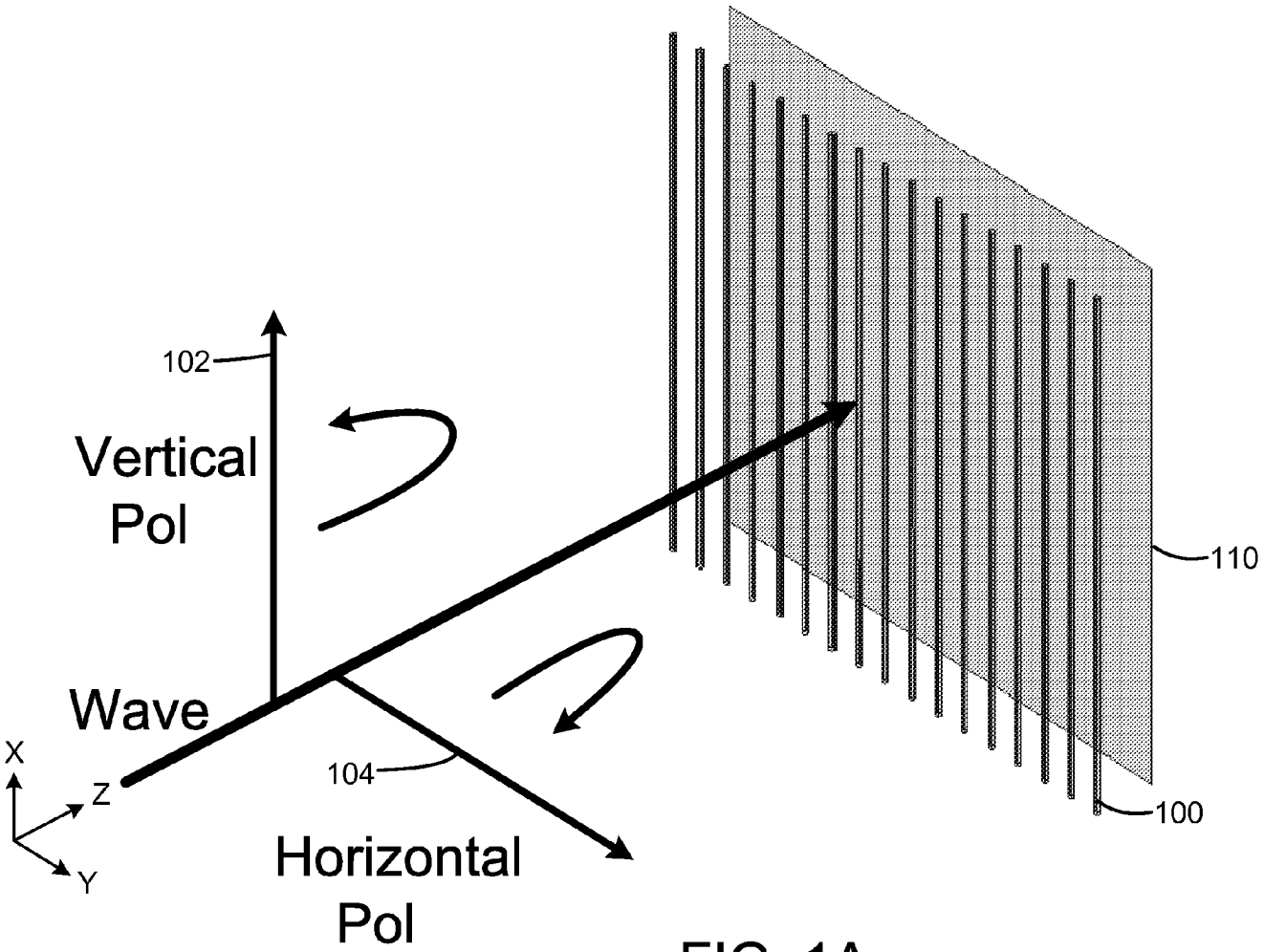
FIG. 1A diagrammatically illustrates two plane waves, vertically and horizontally polarized, respectively, incident upon a conductive vertical grid, spaced from a conductive planar wall.

In the following detailed description and in the several figures of the drawing, like elements are identified with like reference numerals. The figures are not to scale, and relative feature sizes may be exaggerated for illustrative purposes.

This application describes aspects of a new wall design for reflecting electromagnetic energy. An exemplary application of an embodiment of the new wall design is in the field of microwave ovens, with one or more design aspects that can be applied to create a more uniform electric field distribution within a microwave oven. The design aspects include:

1) Modify the wall(s) to be polarization selective so that vertically and horizontally polarized E-fields will be reflected differently, with the result that when integrated, the waves will produce a more uniform 3-dimensional electric field profile. The electric field incident upon the wall can be considered as two separate modes, one vertically polarized and one horizontally polarized. However, as an incident wave it could have any polarization. To insure that both polarizations exist for this use, a wave with equal polarizations is generated. The integration aspect is that at any point in space and time, the present electric field will be the instantaneous combination of four waves, i.e. the incident two waves (both polarizations) and the reflected two waves (also two polarizations). A unique feature is that the total magnitude of these four waves will be a constant at any position and time. The resultant polarization is not relevant for heating most materials, only the field magnitude.

2) Excite the oven with dual polarization with respect to the cavity to take advantage of the reflective differences when a grid arrangement (described more fully below) is in place. For a microwave oven, the cavity typically has a rectangular shape. Any shape enclosed cavity with metal walls would work as a microwave oven. However, an exemplary embodiment of the approach to creating the uniform fields described herein utilizes a flat wall opposite the source of the power wave and the best results would typically be obtained in a rectangular cavity.

3) Offset the input position of the excitation aperture to maximize the uniformity of the fields. Having a single waveguide source is the easiest, most common and least expensive way to excite the oven. Using multiple source apertures can be also used to create a more uniform incident wave in the cross-section to the wave propagation. However, to achieve the uniformity along the axis of propagation, the proposed reflective wall is preferably used.

FIG. 1A diagrammatically illustrates two plane waves 102, 104, vertically and horizontally polarized, respectively, incident upon a conductive vertical grid 100, spaced from a conductive planar wall 110. The polarized wave 102 is parallel to the linear grid 100, and will see it as a reflection surface. The polarized wave 104 perpendicular to the grid 100 will pass by the grid. The conductive planar wall 110 is spaced a distance of one quarter wavelength of the wave frequency.

Two reflections are produced, with high VSWR patterns that look like trigonometry functions. This allows taking advantage of the fact that, when standing waves of separate horizontally and vertically polarized waves are properly positioned with respect to each other (one shifted by $\lambda/4$) and on the same axis, the energy sum is a constant, i.e. uniform.

Figure 1B:
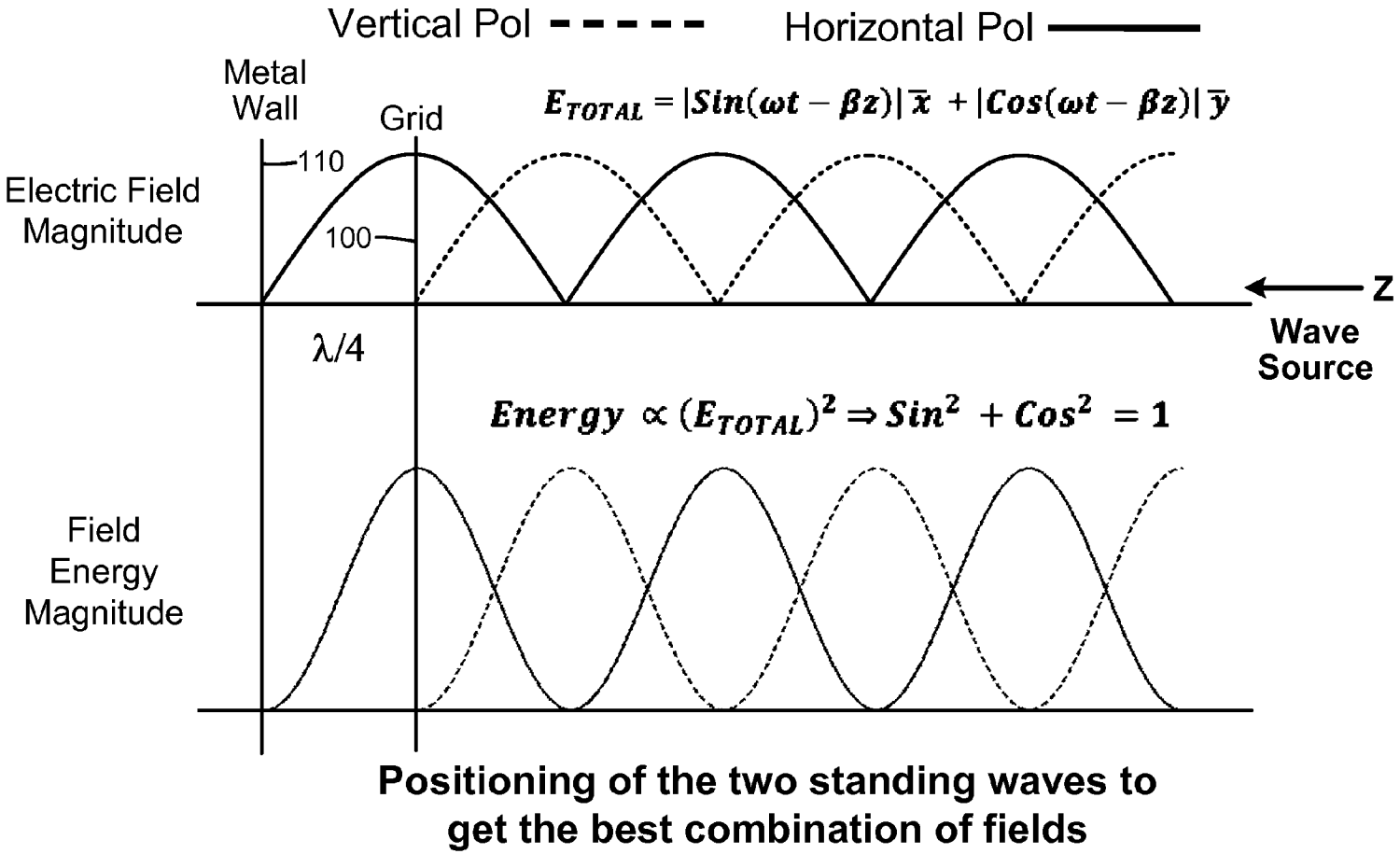
FIG. 1B shows the incident waves and the resultant two standing waves with an ideal quarter wave offset, determined by the positioning of the grid in front of the conductive planar wall of FIG. 1A.

The issue of combining the standing waves of horizontal and vertical waves can be addressed in the following manner. In the upper set of curves of FIG. 1B for the electric field magnitude, there are shown two standing waves with a quarter wave offset, determined by the positioning of the grid 100 in front of the metal outer wall 110. Using the grid position as a reference, the two waves appear as rectified Sin (for the vertical polarized wave) and Cos (for the horizontal polarized wave) functions. Remembering that the waves are orthogonal to each other, the total field is given by:

$$E_{TOTAL}=|\mathrm{Sin}(\omega t-\beta z)|\bar{x}+|\mathrm{Cos}(\omega t-\beta z)|\bar{y}$$

where $\bar{z}$ is the axis of propagation. Consider next the lower set of curves of FIG. 1B ($\sin^2$ and $\cos^2$) which represent the field energy magnitude. Since the heating effect is due to the total energy, which is proportional to the square of the E-fields, this results in:

$$\mathrm{Energy}\propto(E_{TOTAL})^2 \Rightarrow \mathrm{Sin}^2+\mathrm{Cos}^2=1$$

These lower curves sum to a flat line. Note that both the sin and cos arguments for the E-field are dependent upon time (t) and position, or space (z) along the axis of propagation, with the polarization set by the vectors $\bar{x}$ and $\bar{y}$. Since the waves are normal to one another the total squared field is equal to the sum of the squares of both polarizations. And trigonometry shows that $\sin^2+\cos^2=1$ when the sin and cos have the same arguments. Apart from some amplitude coefficient, the result is a constant, no longer dependent on either time (t) or position (z).

Figure 2B:
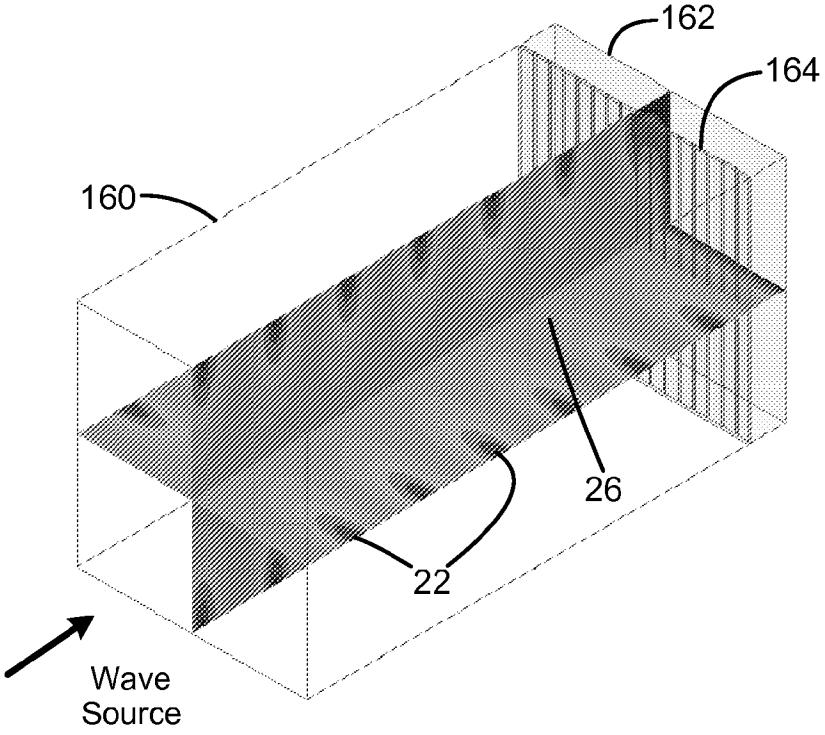
FIG. 2B shows a similar cavity with a plain metal back wall and a metal grid positioned by a quarter wavelength in front of the back wall, with the two cut planes of electric filed patterns generated by the simulation program.
Figure 2A:
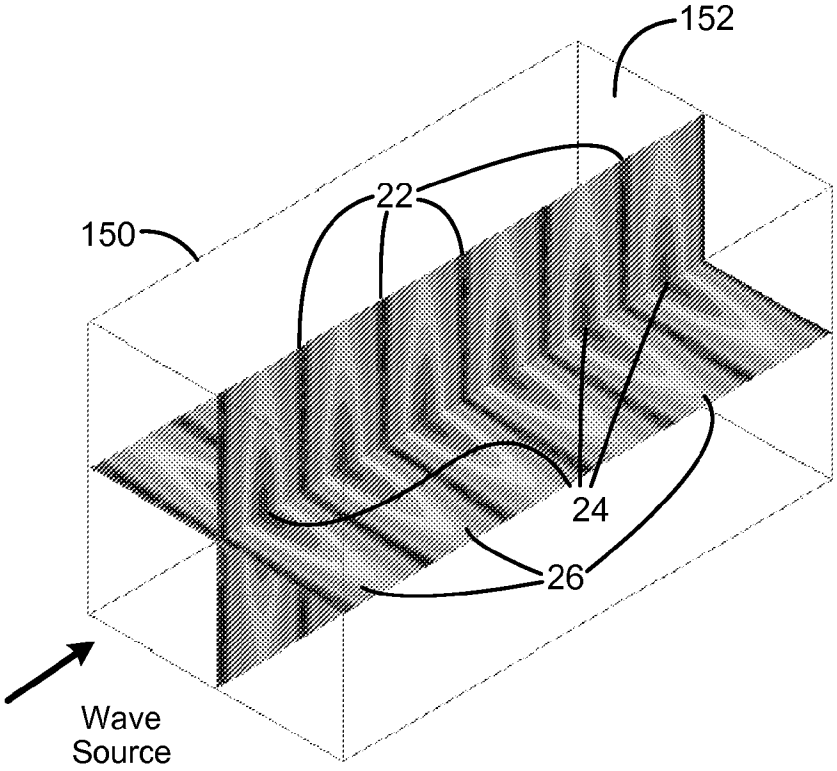
FIG. 2A depicts a cavity with a plain metal back wall, with two cut planes through the combination of vertically and horizontally polarized waves, when both waves are reflected from the same surface, as generated by a simulation program.

Now referring to FIG. 2A, consider a cavity 150 with a plain metal back wall 152. FIG. 2A shows two cut planes through the combination of vertically and horizontally polarized waves incident on the back wall in an HFSS simulation (HFSS, or High Frequency Structure Simulator, a software application, commercially available from ANSYS, Inc., for simulating 3-D full-wave electromagnetic fields), when both waves are reflected from the same surface (wall 152). The result is a strong standing wave pattern on axis, with reference number 22 indicating representative zero or very low electric field strength, 24 indicating representative high electric field strength, and 26 indicating representative medium electric field strength regions. Now consider a cavity 160 with a plain metal back wall 162 and a metal grid 164 positioned by a quarter wavelength in front of the back wall, as in FIG. 2B. With the reflection of the vertically polarized wave made with the polarized grid at a quarter wavelength in front of the wall, the resulting combination of waves is different, as shown in FIG. 2B. Here we see very uniform field strength regions 26 along the axis due to the complementary nature of the two waves. This design can be used in specialized cases to create a very large substantially uniform heating zone, for example. Interference nulls 22 due to side wall reflections are only near the side walls of the cavity 160. These sets of nulls are also offset (top wall relative to side walls) along the axis by the offset of the grid.

Figure 3A:
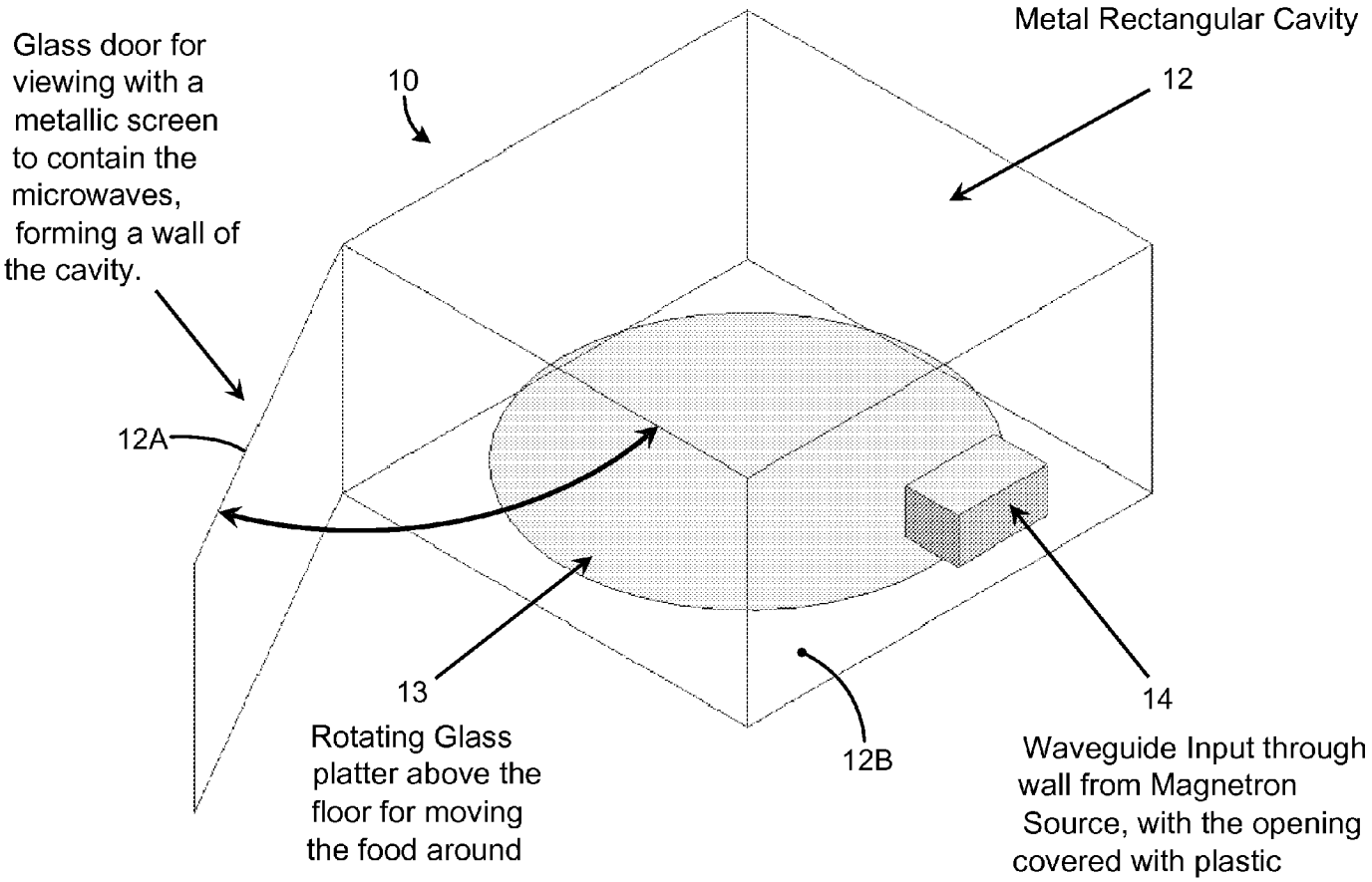
FIGS. 3A and 3B diagrammatically illustrate a typical conventional microwave oven.
Figure 3B:
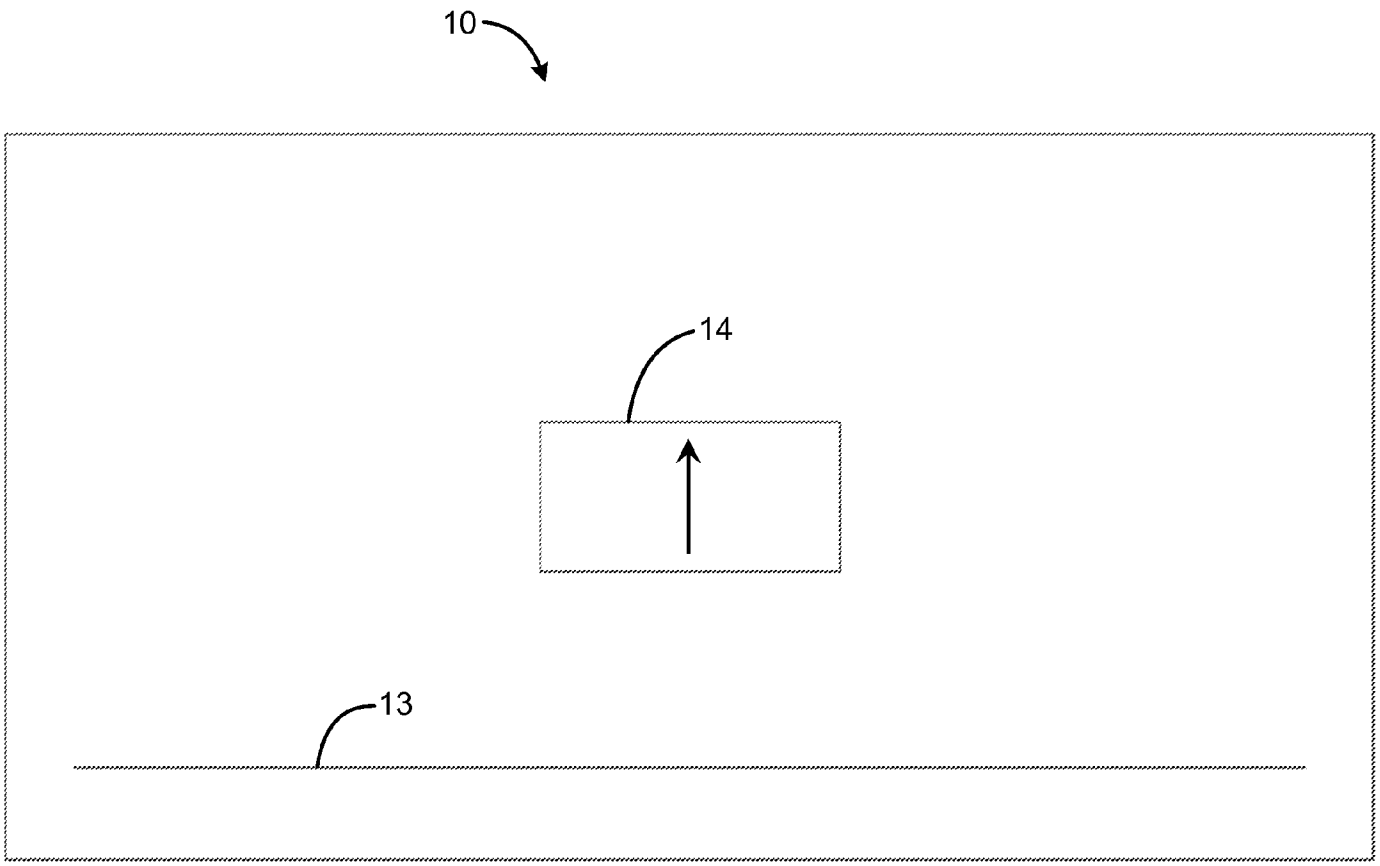
Figure 3D:
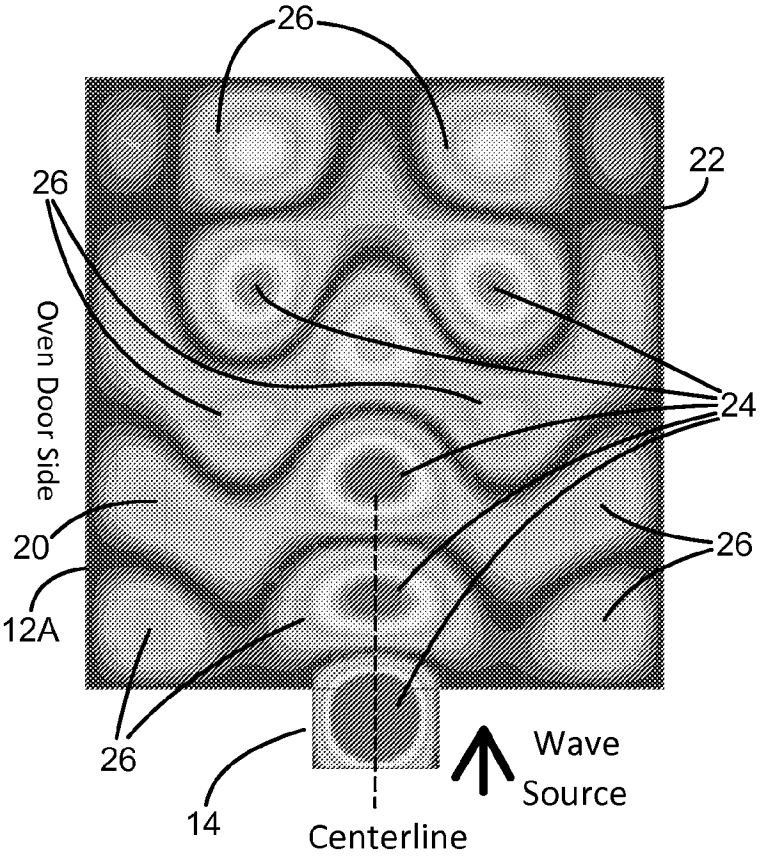
FIGS. 3C and 3D show the electric field distribution of the typical conventional microwave oven through a horizontal mid-cut plane in perspective and top down views, as generated by a simulation program.
Figure 3C:
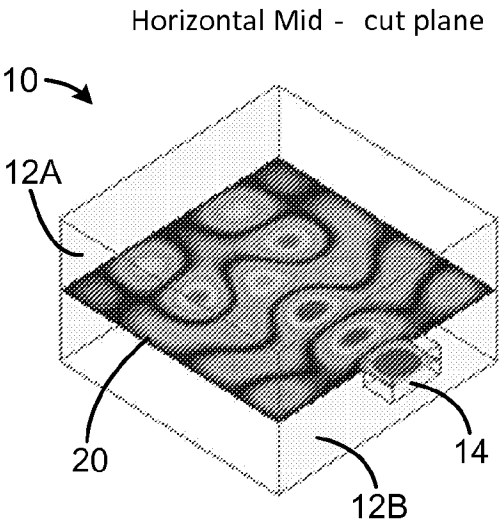

Now consider the E-field of a typical microwave oven 10 illustrated in FIGS. 3A and 3B. A rotating glass platter 13 may be mounted above the oven floor for moving the food around within the cavity 12. Typically the oven walls are metal or metal-coated plastic walls, with the door 12A made of glass for viewing, with a metallic screen to contain the microwave energy This exemplary oven is 15.5w×15.5d×8.25h inches with flat highly reflective (to incident electromagnetic energy) walls on all sides. The input source waveguide 14 is centered in the sidewall 12B, and is 1.7 inch×3.4 inch waveguide (WR 340). The waveguide opening is typically covered with plastic. The waveguide is connected to a microwave generator, such as a magnetron, through an isolator to protect the source from energy reflected from the cavity. The source frequency is standard at 2.45 GHz. FIGS. 3C and 3D show the electric field distribution of the typical oven 10 through the horizontal mid-cut plane 20 in perspective and top down views, as generated by the HFSS program. The reference number 22 points to near zero field magnitude in the plane 20, the reference number 24 points to the peak field magnitude value, with reference number 26 indicating areas of a midrange field value. The modal patterns of the electric field are evident from the simulation results, and clearly would contribute to uneven heating of food.

In an exemplary embodiment of a microwave oven in accordance with aspects of this invention, primary and secondary grids or grid walls are placed in front of two of the walls, and the source is a dual polarization source. The primary grid wall is opposite the source, and the combination of the dual polarized source and the primary grid wall create the uniform E-field. However, due to the existence of the other cavity walls, plus the fact that the source is not planar like the grid wall, there will still be other extraneous reflections within the cavity (oven). Therefore, another grid wall (secondary) may be utilized to affect the waves which are incident upon that wall as well. The secondary wall is optional, but still does contribute to the improvement of the field distribution in a microwave oven application. These grids walls provide different reflection depending upon the polarization of the incident waves, essentially creating standing waves in two different positions depending upon the wave polarization. This allows taking advantage of the fact that when standing waves of separate horizontal and vertical waves are properly positioned with respect to each other (offset by wavelength/4) and on the same axis, the energy sum is a constant, i.e. uniform.

It should be understood that this substantially uniform reflection is with respect to one reflecting surface (wall), and that the energy distribution within a microwave oven is also highly dependent upon the size, type and position of the food placed inside. Therefore, it is not suggested that there will ever be a perfectly uniform field including the food. However, it makes sense that if the field distribution prior to introducing food is much more uniform than for an uneven distribution, then it is likely that cooking within the uniform field distribution will result in a more uniform result than for the uneven field distribution. It may still be worthwhile to include the rotating table to additionally average the heating.

In an exemplary microwave embodiment, the microwave source provides both polarizations to the oven cavity. This may be done simply by tilting the input waveguide 45 degrees with respect to the cavity walls.

Knowing there will be waves scattered all throughout the oven cavity, particularly when food is inside, it makes sense also to use the grid on two walls, contributing to the "smoothing" of the energy distribution.

A further aspect of this approach is to consider the variations in distribution as a function of positioning the source at various locations inside of the oven. Horizontal shifting of the source positioning is considered below, although vertical movement could also be employed.

Figure 4A:
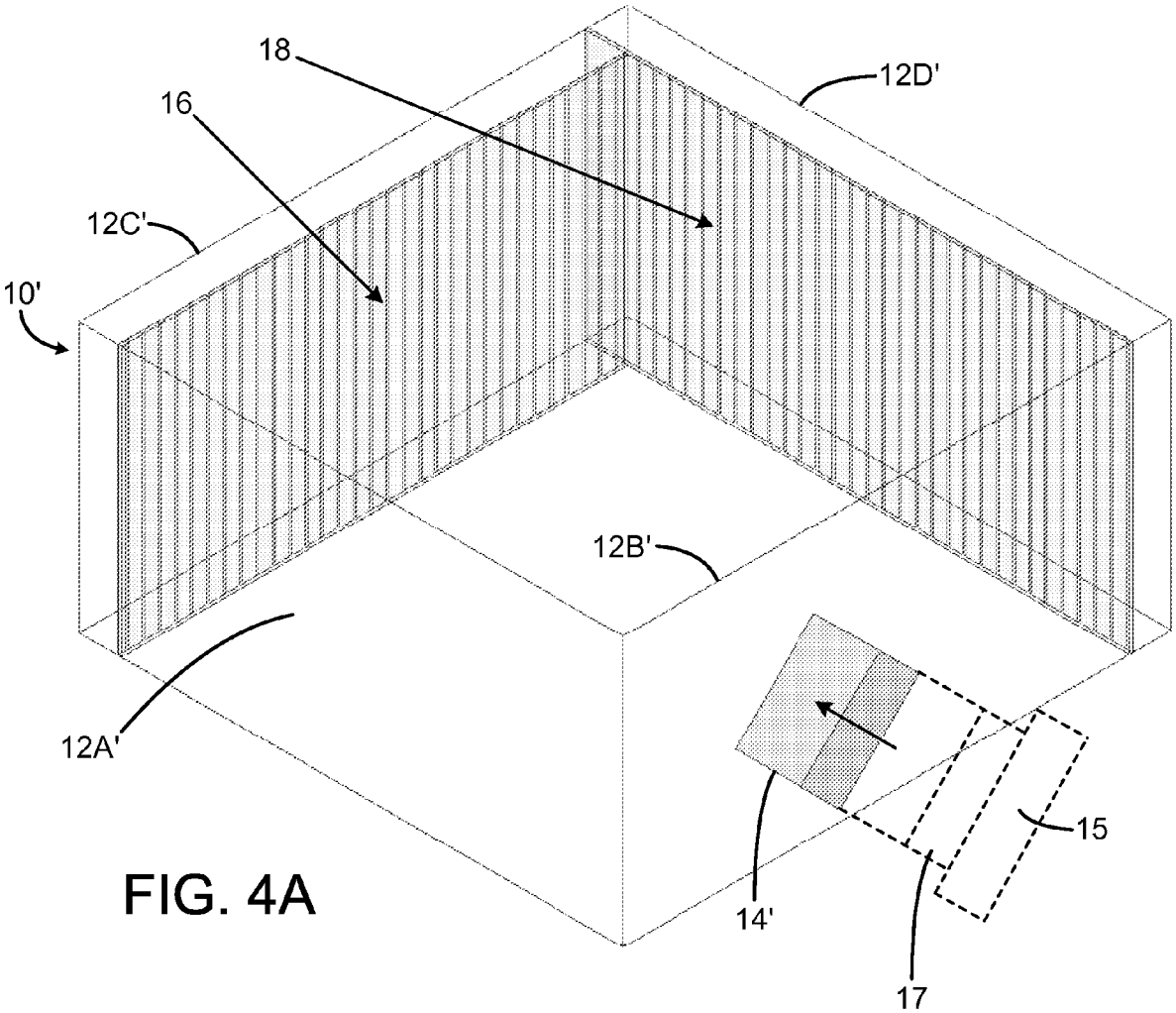
FIG. 4A diagrammatically illustrates an exemplary embodiment of a microwave oven in accordance with aspect of this invention.
Figure 4B:
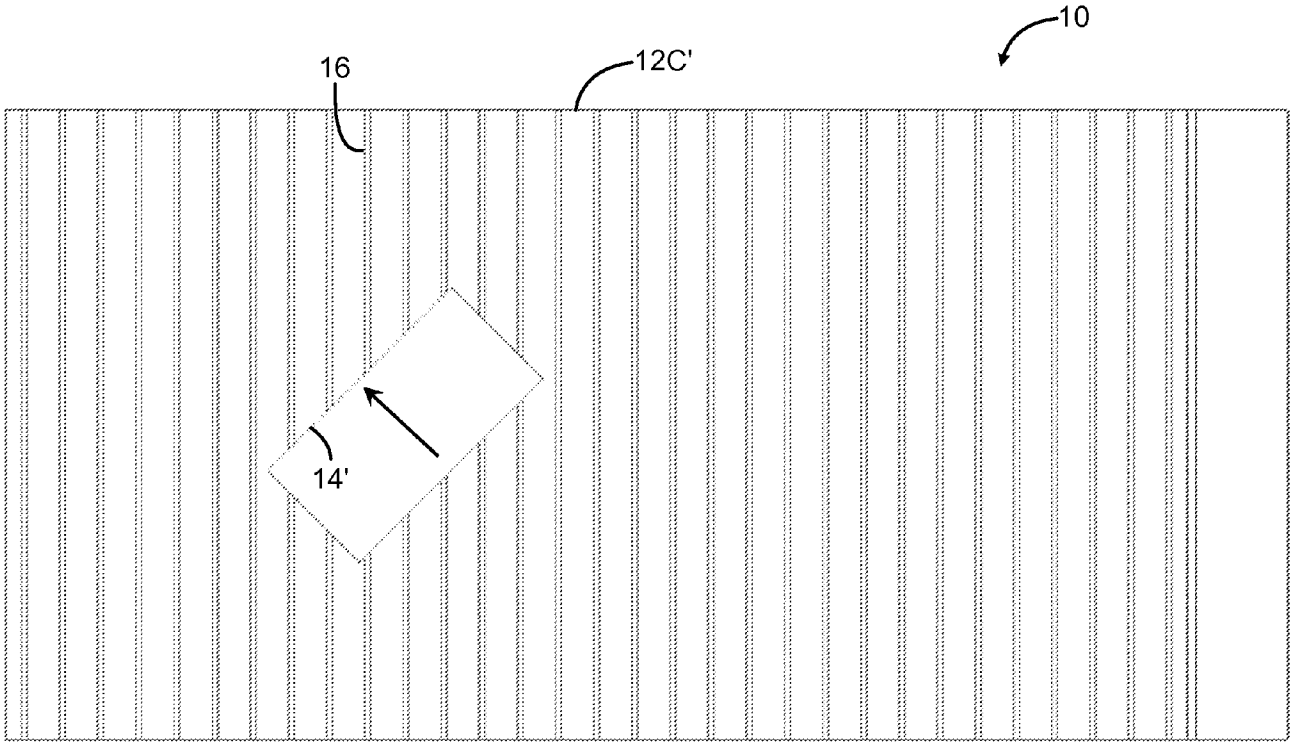
FIG. 4B is a side view, looking from the side wall with the waveguide port to the opposite side wall with a grid positioned in front.
Figure 4D:
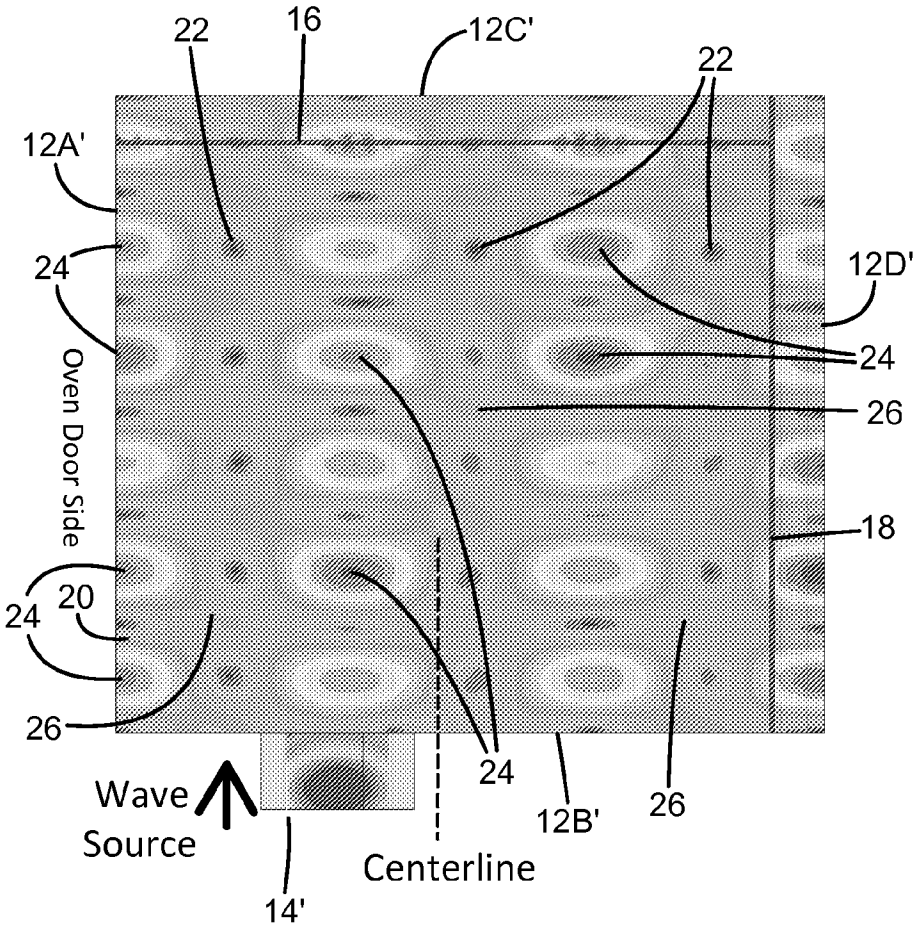
FIGS. 4C and 4D show the E-field distribution in a horizontal mid-plane cut of the embodiment, as generated by a simulation program.
Figure 4C:
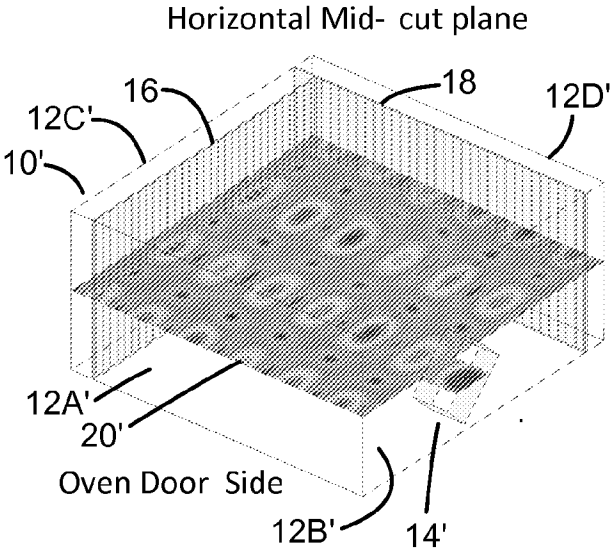

FIGS. 4A and 4B show an exemplary embodiment of a microwave oven 10' embodying aspects of the invention, and FIGS. 4C and 4D show the E-field distribution in a horizontal mid-plane cut, as generated in an HFSS simulation. Grids or grid walls 16 and 18 are installed in front of side walls 12C' and 12D', with grid wall 16 located in front of the wall opposite the input source waveguide 14', which is mounted to side wall 12B'. The source waveguide 14' is cocked at a 45 degree angle, relative to the orientation of the source waveguide 14 in the conventional oven 10 (FIG. 3A). The source waveguide 14' is also offset from the centerline of the sidewall 2.5 inches in this embodiment. Tilting of the input waveguide excites both horizontally and vertically polarized waves within the oven cavity. A microwave generator such as a magnetron 15 is connected to the waveguide through an isolator 17. The use of an isolator is conventional, and protects the generator from energy reflections from the oven cavity back into the source. The two walls 12C' and 12D' are 1.2 inch deeper than the conventional design (illustrated in FIG. 3A), with grid walls 16 and 18 set at the quarter wave spacing from the solid walls. Reference numbers 22, 24, 26 again refer to exemplary areas of low, high and midrange electric field magnitudes in the horizontal mid-cut plane 20', again as calculated by the HFSS simulation program. Not only are the values of the nulls and peaks less extreme than for the conventional oven 10 of FIGS. 3C and 3D, they are much closer together spatially, providing better uniformity of heating through thermal conduction.

FIG. 4A shows the primary and second grid walls 16, 18 which reflect vertically polarized waves. The horizontally polarized waves pass by these grids and reflect off the outside walls. Both horizontal and vertically polarized waves are excited by the source waveguide 14' which is tilted at 45 degrees. FIG. 4B shows clearly the offset of the wave source from the oven center line, the position chosen to create the most even distribution. The offset in this exemplary configuration is 2.5 inches and was determined by multiple simulations of the E-fields by adjusting the position of the source, using the HFSS computer simulation program. Vertical adjustment could also have been done and would be done to optimize a specific configuration but was not necessary here to prove the value of the grid walls. Also the vertical grids 16, 18 positioned in front of the top and right hand walls 12C' and 12D' are visible in FIG. 2320. 4B.

The spacing between the wall and adjacent grid depends upon whether there is any dielectric between the grid and the wall. The actual preferred physical dimension is a quarter wavelength within the dielectric at the source frequency of 2.45 GHz, in this exemplary embodiment. For air dielectric, the spacing is 1.204 inches. This spacing could be varied somewhat, with the optimum spacing at a quarter wavelength, but improved uniformity is still achieved even if the spacing varies somewhat from the quarter wavelength spacing. Using a spacing between the wall and the grid of an odd number of quarter wavelengths would also theoretically work but would be inefficient because of the extra wasted volume behind the grids. Improved uniformity can still be achieved even if the spacing varies somewhat from the ideal quarter wavelength spacing, but will degrade the improved uniformity proportionally the more the difference from that ideal. For example, using the nominal quarter wavelength spacing results in a voltage standing wave ratio (VSWR) of 1:1 which represents a uniform magnitude. If the spacing is varied by one twelfth wavelength from the nominal, the VSWR will increase to 3:1. For reference, with no grid the VSWR is infinity. Considering next the lateral spacing between the grid lines, this is nominally set to 0.1 wavelength (~0.5 inch in air) and the width of each grid line is set to 0.02 wavelength (~0.1 inch in air), in this exemplary embodiment. These grid dimensions are not critical, but the more important of the two is the lateral spacing. As the lateral spacing increases (larger than 0.1 wavelength), the reflection of the parallel wave will be reduced and the unreflected portion will pass the grid and be reflected off the metal wall. This will disrupt the balance in magnitude between the two polarizations, resulting in peaks and valleys in the total field. Eventually, with large grid spacings relative to wavelength, all of the energy from both polarizations will reflect off the wall and behave more like a typical oven design. Simulations show that even with the lateral spacing as large as 0.3 wavelength, there is still substantial improvement in the uniformity as compared to not having the grid. At 0.3 wavelength spacing, the energy reflected off the grid is approximately 50%, resulting in a VSWR of approximately 2:1. (Assuming that the distance to the wall is still quarter wavelength.) The function of the grid is to let the horizontal polarization component of the incident energy (normal to the grid) pass through the grid by with little reflection, and to highly reflect the vertical polarization component of the incident energy (parallel to the grid). The grid dimensions given at 0.1 wavelength lateral spacing and 0.02 wavelength grid line width result in 99% of the vertical polarization wave being reflected and 99% of the horizontal polarization wave passing through. The grid wall approach would still provide some improvement in the field uniformity even with as little as 50% reflection off the grid.

The design would work equally well with horizontal grids as with the illustrated vertical grids. The choice will depend upon whichever is easiest to implement for a given application.

In the exemplary embodiment of a microwave oven 10' in FIGS. 4A, 4B, the source waveguide is tilted 45 degrees to create dual polarization. Dual polarization can be realized in numerous ways known in the art. One way is to use a dual mode source with a square or circular waveguide but that would require the creation of both modes within the waveguide. Another exemplary way would be to have two independent sources with orthogonal orientation to one another. The 45 degree rotation of the source waveguide is just a simple way to do it. Excitation of dual polarization waves, in combination with the grid and the wall, achieves the uniform field. The RF generator 15 (FIG. 4A) feeds the waveguide entry 14' into the cavity which is on the wall opposite the primary grid. There are many potentially viable configurations where the energy source could be on the top, bottom or side wall as shown here. The primary grid will be on whatever surface is opposite the source and aligned with one of the two equal amplitude polarization waves from the source.

In a general sense, a feature of the approach is to have a grid wall placed in front of at least one of the walls of the oven, the grid wall providing different reflection depending upon the polarization of the incident wave, essentially making the walls look like they are in two different positions depending upon the wave polarization. This will provide more uniform distribution of the oven energy, which will help in providing more uniform heating when integrating around the circular paths of the food items. Knowing there will be waves scattered all throughout the cavity, particularly when food is inside, it makes sense also to put the grid wall on two walls, contributing to the "smoothing" of the energy distribution. A third aspect of this approach is to consider the variations in distribution as a function of positioning the source waveguide along the side of the oven.

Figure 5A:
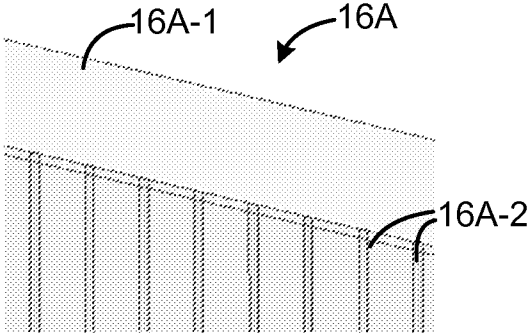
FIGS. 5A, 5B and 5C illustrate different exemplary implementations of a grid wall.
Figure 5B:
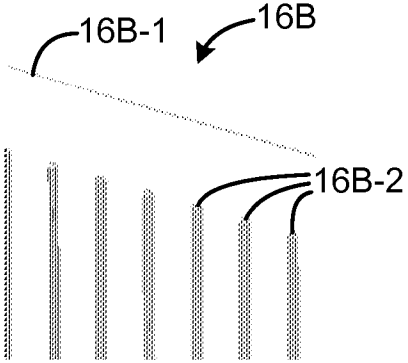
Figure 5C:
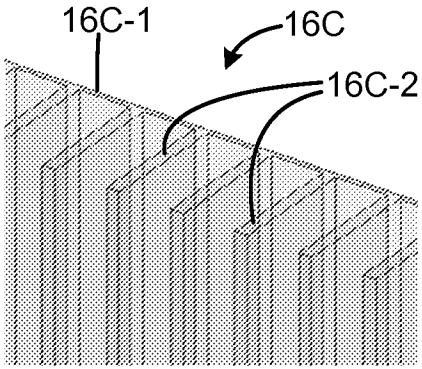

There are various techniques to implement the grid walls, by any means which creates a polarized grid which can be placed in front of a metal back wall. A preferred technique is to form metallized strips on a surface of a thin plastic (dielectric) sheet. This is illustrated in FIG. 5A, as grid wall 16A, comprising a thin plastic wall, i.e. a dielectric sheet, 16A-1 with metallized strips 16A-2 formed on a back surface of the plastic wall. Another option, depicted in FIG. 5B, is to mount thin metal wires 16B-2 on the back of thin plastic (dielectric) board i.e. a dielectric sheet, 16B-1. A further option, depicted in FIG. 5C, is to form thin metal or metallized molded plastic vanes 16C-2 extending outwardly from a thin metalized back wall 16C.

This application has proposed and demonstrated through the use of HFSS, a method and steps to make the E-field within a microwave oven more evenly distributed, which should result in a more uniform heating of the food, which is the desired goal. The exemplary technique discussed focuses on redesign of at least one, and optionally, two of the walls of the oven to alter the reflection characteristics. The forgoing discussion has specifically dealt with a relatively small size oven but could easily be applied to any other using microwaves for heating, including industrial ovens.

It is found that significant improvement in the uniformity of the electric field within the oven cavity can be achieved just by tilting by 45 degrees the waveguide input into the cavity in the conventional oven. Thus, by modifying the conventional microwave oven depicted in FIG. 3A by tilting waveguide 14 by 45 degrees creates both vertical and horizontal electric field polarizations, and a more uniform electric field distribution. This is a further embodiment of a microwave oven in accordance with an aspect of the invention. When used in conjunction with a grid wall as described above, even greater improvement in the electric field distribution is achieved.

A further aspect in improving the uniformity of the electric field distribution is to move the tilted input waveguide away from the center line of the wall in which it introduces energy into the cavity. For the exemplary embodiment of FIGS. 4A-4B, a 2.5 inch offset from the center line of the wall was found to produce the most uniform field distribution.

Another embodiment of this invention in a microwave oven is to place the grid in conjunction with the bottom wall of the cavity and excite the oven from the top surface. An array of sources may be used in combination to create a more planar wave-front incident upon the grid and bottom wall. This would maximize the use of the largest reflecting surface within the oven creating the uniform nature of the electric fields. A rotating platter could still be placed above the grid, as such a platter is typically raised above the bottom.

Although the foregoing has been a description and illustration of specific embodiments of the subject matter, various modifications and changes thereto can be made by persons skilled in the art without departing from the scope and spirit of the invention.

What is claimed is:

1. A microwave oven, comprising:

an oven cavity, defined by oven walls, said oven walls highly reflective to incident electromagnetic energy;

a microwave source for generating microwave energy and launching the microwave energy into the oven cavity from a port formed in a first one of the oven walls, wherein the launched microwave energy includes first and second energy components, said first and second energy components being linearly polarized components which are orthogonal to each other;

a planar grid comprising a set of linear spaced, parallel, electrically conductive lines, said set parallel to a polarization direction of a first one of said first and second linearly polarized components, said grid configured to reflect incident microwave energy of said first one of said linearly polarized components and to allow incident energy of said second linearly polarized component to pass through the grid;

said grid positioned inside said cavity and spaced from a second one of said oven walls, said second one of said oven walls being opposite said first one of said oven walls;

wherein the oven is configured such that the second linearly polarized component of the incident energy is reflected by the second oven wall, and wherein the first and second linearly polarized components reflected respectively by the grid and the second oven wall combine to form a standing wave pattern in the oven cavity having a more uniform electric field than what would result without the grid.

2. The microwave oven of claim 1, further comprising a sheet of dielectric material on which the set of linear parallel, electrically conductive lines is formed.

3. The microwave oven of claim 1, further comprising a sheet of dielectric material, and wherein the set of linear parallel, electrically conductive lines is defined by a set of wires attached to the sheet.

4. The microwave oven of claim 1, further comprising:

a second planar grid comprising a second set of linear parallel, electrically conductive lines, said second set parallel to said first set of linear parallel electrically conductive lines;

said second grid positioned inside said cavity and spaced from and parallel to a third one of said oven walls, said third one of said walls being perpendicular to said first one of said cavity walls.

5. The microwave oven of claim 1, wherein said microwave source comprises a microwave generator and a rectangular waveguide connected between the microwave generator and the port, said rectangular waveguide oriented at a 45 degree angle from the polarization direction of the first component, and configured to generate said first and second polarization components.

6. The microwave oven of claim 1, wherein said grid is spaced from said second one of said oven walls by a distance nominally equivalent to a quarter wavelength of said launched microwave energy.

7. The microwave oven of claim 1, wherein said grid lines are 80 mils (thousandths of an inch) wide at a spacing of 500 mils.

8. The microwave oven of claim 1, wherein the port in the first one of the oven walls is offset from a center of the first one of the walls, thereby improving uniformity in the electric fields within the cavity.

9. A microwave oven, comprising:

an oven cavity, defined by flat, electrically conductive oven walls, one of said walls comprising an oven door, said oven walls highly reflective to incident microwave energy;

a microwave source for generating microwave energy and launching the microwave energy into the oven cavity from a port formed in a first one of the oven walls, wherein the launched microwave energy includes first and second linearly polarized components which are orthogonal to each other;

a first planar grid comprising a first set of linear parallel, electrically conductive lines, said lines parallel to a polarization direction of said first linearly polarized component, said first grid parallel to and spaced from a second one of said oven walls, said second one of said oven walls being opposite and parallel to said first one of said oven walls;

wherein said first grid is configured to reflect at least 50% of the first one of said polarization components of the incident energy parallel to the first grid set and to allow the other of the components of the incident energy which is normal to the grid set to pass through the grid set with little reflection for reflection from the second one of the oven walls; and a second planar grid comprising a second set of linear parallel, electrically conductive lines, said set parallel to said first set of linear parallel electrically conductive lines, said second grid wall spaced from and parallel to a third one of said oven walls, said third one of said oven walls being perpendicular to said first one of said oven walls.

10. The microwave oven of claim 9, further comprising, for each of said first and second grids, a sheet of dielectric material on which the set of linear parallel, electrically conductive lines is formed.

11. The microwave oven of claim 9, further comprising, for each of said first and second grids, a sheet of dielectric material, and the set of linear parallel, electrically conductive lines is defined by a set of wires attached to the sheet.

12. The microwave oven of claim 9, wherein said microwave source comprises a microwave generator and a rectangular waveguide connected between the microwave generator and the port, said rectangular waveguide oriented at a 45 degree angle from the polarization direction of the first component, and configured to generate said first and second polarization components.

13. The microwave oven of claim 9, wherein:

said first grid is spaced from said second one of said oven walls by a distance nominally equivalent to a quarter wavelength of said launched microwave energy; and said second grid is spaced from said third one of said oven walls by a distance nominally equivalent to a quarter wavelength of said launched microwave energy.

14. The microwave oven of claim 9, wherein said grid lines of the first and second grids are 80 mils (thousandths of an inch) wide at a spacing of 500 mils.

15. The microwave oven of claim 9, wherein the port in the first one of the oven walls is offset from a center of the first one of the walls, thereby improving uniformity in the electric fields within the cavity.

16. A microwave oven, comprising:

a rectilinear oven cavity, defined by oven walls, said oven walls highly reflective to incident electromagnetic energy;

a microwave source for generating microwave energy and launching the microwave energy into the oven cavity from a port formed in a first one of the oven walls, wherein the launched microwave energy includes first and second energy components, said first and second energy components being linearly polarized components which are orthogonal to each other;

a planar grid comprising a set of linear spaced, parallel, electrically conductive lines, said set parallel to a polarization direction of a first one of said first and second linearly polarized components, said grid configured to reflect incident microwave energy of said first one of said linearly polarized components and to allow incident energy of said second linearly polarized component to pass through the grid;

a dielectric structure on which the set of linear parallel, electrically conductive lines is formed;

said grid positioned inside said cavity and spaced from a second one of said oven walls by a distance nominally equivalent to a quarter wavelength of said launched microwave energy, said second one of said oven walls being opposite said first one of said oven walls;

wherein the oven is configured such that the second linearly polarized component of the incident energy is reflected by the second oven wall, and wherein the first and second linearly polarized components reflected respectively by the grid and the second oven wall combine to form a standing wave pattern in the oven cavity having a more uniform electric field than what would result without the grid.

17. The microwave oven of claim 16, wherein the port in the first one of the oven walls is offset from a center of the first one of the walls, thereby improving uniformity in the electric fields within the cavity.

* * * * *